US007373965B2

(12) United States Patent
Cheng

(10) Patent No.: US 7,373,965 B2
(45) Date of Patent: May 20, 2008

(54) WINDOW SHADE LIFT CORD APPARATUS

(76) Inventor: Li-Ming Cheng, No. 215, Jiouru 1st Rd., Sanmin District, Kaohsiung City (TW)

( * ) Notice: Subject to any disclaimer, the term of this patent is extended or adjusted under 35 U.S.C. 154(b) by 361 days.

(21) Appl. No.: 11/109,805

(22) Filed: Apr. 20, 2005

(65) Prior Publication Data

US 2006/0237144 A1 Oct. 26, 2006

(51) Int. Cl.
*E06B 9/38* (2006.01)

(52) U.S. Cl. ..... 160/178.2; 160/173 R

(58) Field of Classification Search ..... 160/84.04, 160/84.05, 168.1 R, 173 R, 170, 178.1 R, 160/178.2; 24/115 G
See application file for complete search history.

(56) References Cited

U.S. PATENT DOCUMENTS 1,616,881 A * 2/1927 Wharton ..... 24/115 R
4,328,605 A * 5/1982 Hutchison et al. ..... 24/115 G
4,811,466 A * 3/1989 Zubli ..... 24/115 G
5,323,514 A * 6/1994 Masuda et al. ..... 24/115 G
5,548,873 A * 8/1996 Macias ..... 24/134 R
6,443,207 B1 * 9/2002 Cheng et al. ..... 160/84.04
6,672,237 B2 * 1/2004 Hillier ..... 114/230.2
6,845,801 B2 * 1/2005 Hsu ..... 160/84.04
2004/0094274 A1 * 5/2004 Judkins ..... 160/170
2005/0274466 A1 * 12/2005 Hsu ..... 160/168.1 R

* cited by examiner

*Primary Examiner*—Blair M. Johnson
(74) *Attorney, Agent, or Firm*—Muncy, Geissler, Olds & Lowe, PLLC

(57) ABSTRACT

A window shade lift cord apparatus includes a seat, a control switch and a cord assembly. The seat has an aperture on the bottom and axles in the interior. The control switch includes an anchor member and a depressing member that are movably coupled together and interposed by an elastic element. The anchor member and the depressing member have respectively two through holes and two openings. The cord assembly has cords treading through the aperture of the seat, through holes and openings of the anchor member and depressing members such that the lower ends of the cords are gathered beneath the seat. Retracting of the window shade can be accomplished rapidly and simply.

4 Claims, 8 Drawing Sheets

WINDOW SHADE LIFT CORD APPARATUS

BACKGROUND OF THE INVENTION

1. Field of the Invention

The present invention relates to a window shade lift cord apparatus and particularly to a lift cord apparatus for retracting a window shade.

2. Brief Discussion of the Related Art

Conventional window coverings such as shade, blinds, and the like mainly aim to block external light from entering indoors, and serve ornamental purpose. Refer to FIG. 1 for the structure of a window covering 10 proposed by the Applicant in U.S. Pat. No. 6,443,207. It mainly includes an upper track 11, a lower track 12, a foldable pleat 13, two cords 14 and 15, and two adjustment switches 16 and 17. The pleat 13 is located between the upper track 11 and the lower track 12. The two cords 14 and 15 oppose each other and tread through the pleat 13. The two adjustment switches 16 and 17 are located beneath the lower track 12 to control the movement of the two cords 14 and 15.

When in use to retract the pleat 13 of the window covering 10, a user has first to control the adjustment switches 16 and 17 to make the cords 14 and 15 in a movable condition. Then pull the cords 14 and 15 downwards to lift the pleat 13 upwards for retraction. To lower the pleat 13, also control the two adjustment switches 16 and 17 to make the cords 14 and 15 in a movable condition, then the pleat 13 drops automatically because of gravity force for extension. Thereby the window covering 10 can be retracted and extended as desired.

However, during retracting operation of the window covering 10, the two adjustment switches 16 and 17 have to be controlled, and the two cords 14 and 15 have to be pulled downwards. Hence the user has to use one hand to control the adjustment switch 16 on one side and another hand to pull the cord 14 to retract one side of the window covering 10 upwards to a selected elevation, then to control another adjustment switch 17 with one hand on another side and pull another cord 15 with another hand to retract another side of the window covering 10 to the selected elevation. In other words, the operations have to be done repeatedly and alternately on two sides to lift the pleat 13 and retract the window covering 10 to the desired elevation. It is a tedious process.

SUMMARY OF THE INVENTION

Therefore the primary object of the present invention is to provide a window shade lift cord apparatus to retract the window shade easier.

To achieve the foregoing object, the window shade lift cord apparatus according to the invention includes a seat, a control switch and a lift cord assembly. The seat is an elongate and hollow member having a slot on the top side, an aperture on the bottom and axles on two sides of the aperture vertical to the axis of the long side of the seat. The control switch is located on the bottom side of the seat corresponding to the aperture and includes an anchor member and a depressing member that are movably coupled, and an elastic element located between the anchor member and the depressing member. The anchor member has two through holes on two opposing sides corresponding to the aperture of the seat. The depressing member has two opposing openings corresponding to the two through holes of the anchor member. The lift cord assembly has a plurality of cords threading through the seat, winding around the axles and passing through the aperture of the seat. Each cord has a lower end passing through the through holes of the anchor member and openings of the depressing member.

The structure set forth above can achieve the following effects: The apparatus can be directly installed on the window shade to retract the slats of the window shade. By threading the cords through the aperture of the seat, through holes of the anchor member and openings of the depressing member, the lower ends of the cords are gathered beneath the seat. Through a single control switch, the movement of the cords may be controlled. During retracting of the window shade, a user can depress the depressing member with one hand, and pull the lower ends of the cords with another hand to retract the window shade at one process. Operation is simpler and quicker. It is more convenient.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
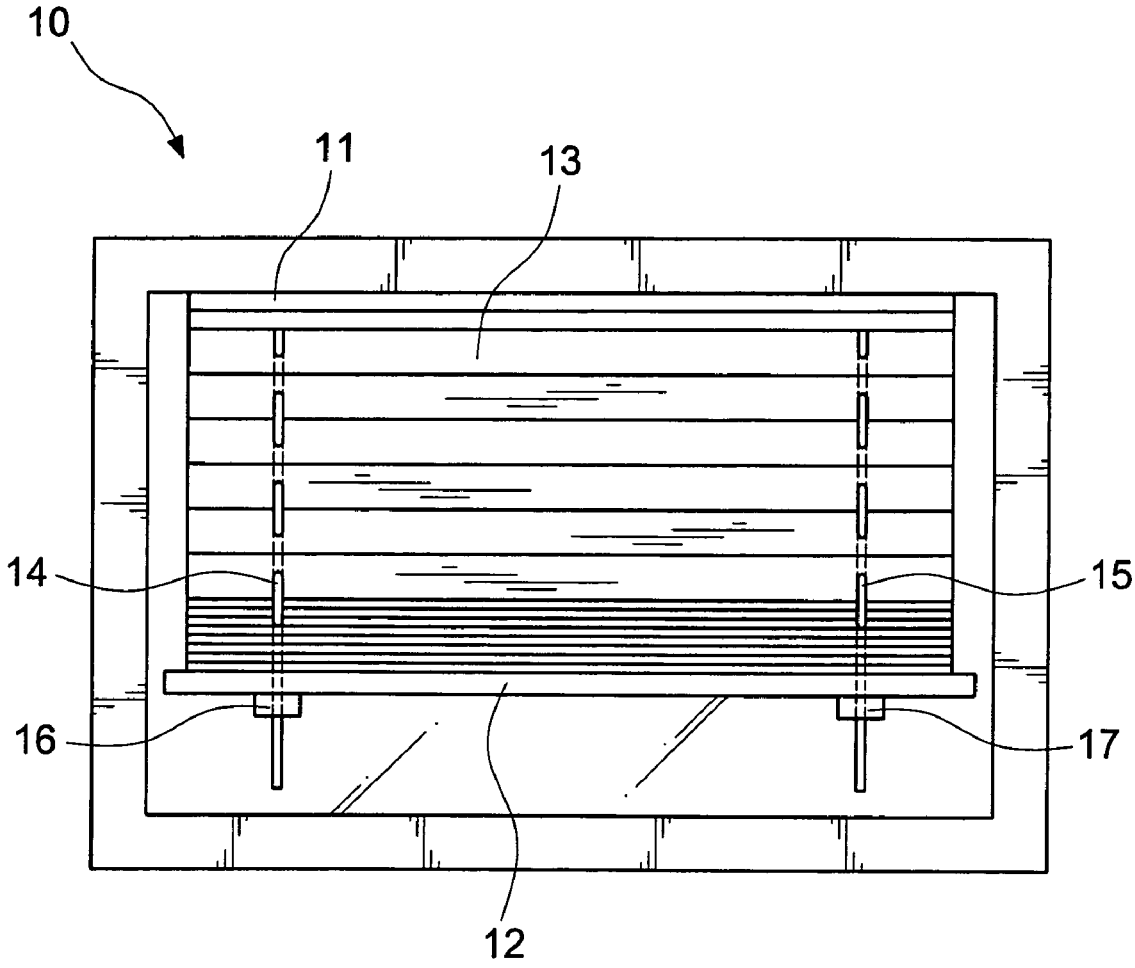
Fig.1 PRIOR ART
FIG. 1 is a schematic view of U.S. Pat. No. 6,443,207.
Figure 2A:
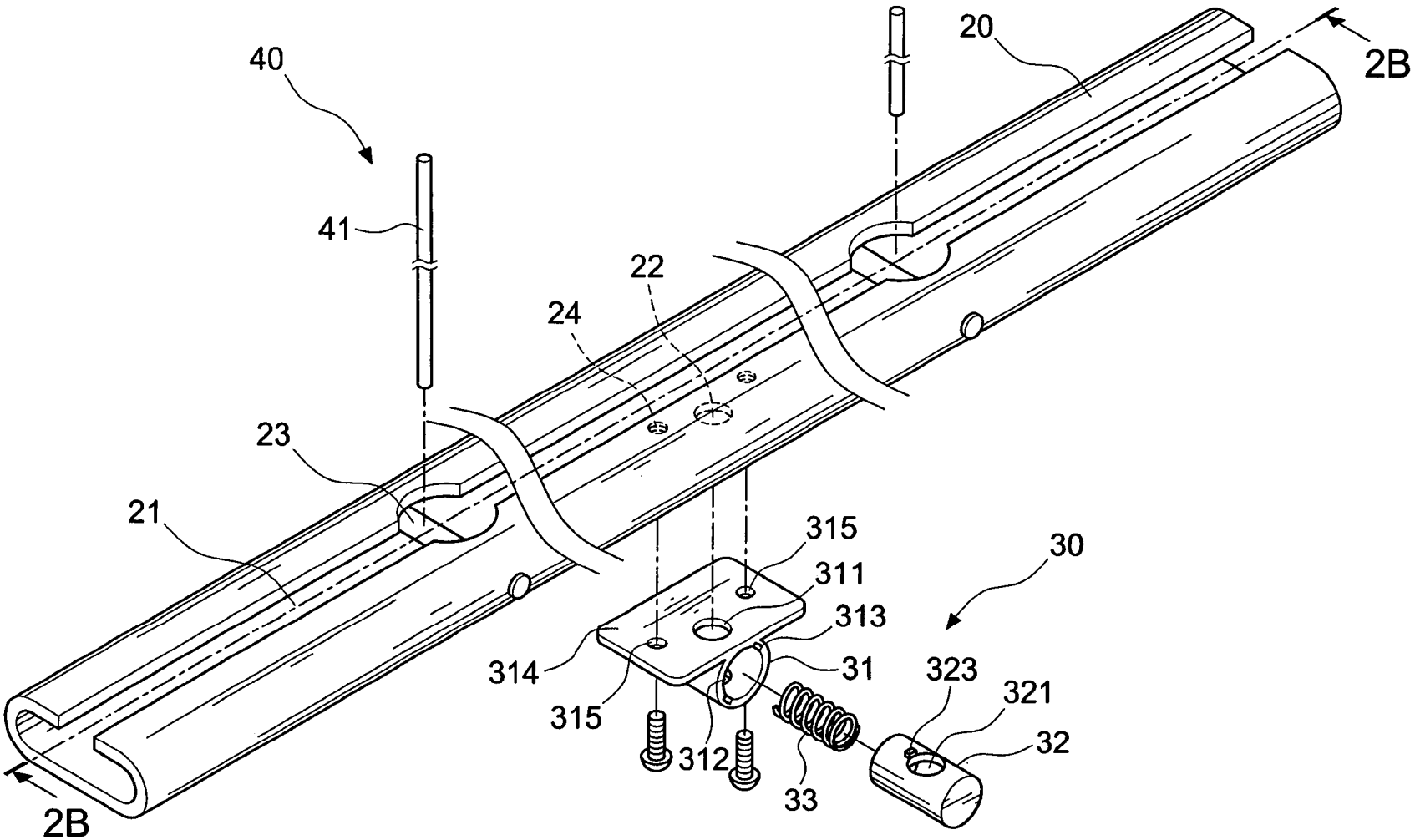
FIG. 2A is an exploded view of the present invention.

Please refer to FIG. 2A for an embodiment of the invention. The window shade lift cord apparatus according to the invention mainly includes a seat 20, a control switch 30 and a cord assembly 40.

The seat 20 is an elongate and hollow structure having a slot 21 on the top, an aperture 22 on the bottom leading to the interior and a plurality of axles 23 on two sides of the aperture 22 vertical to the axis of the long side of the seat 20. The number of the axles 23 mating the number of cords of the lift cord assembly 40. In this embodiment, there are two axles 23 located on two sides of the aperture 22.

Figure 2B:
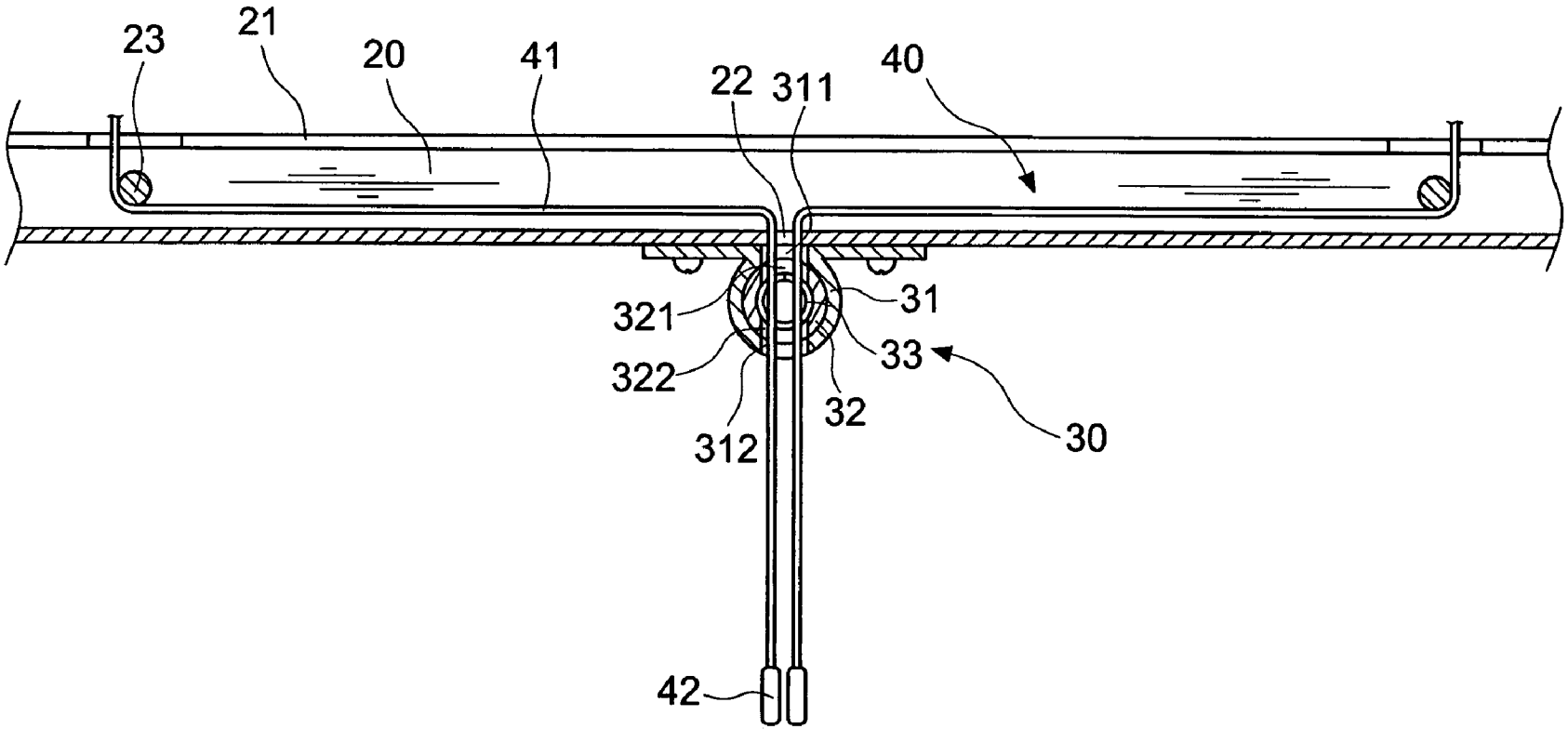
FIG. 2B is a cross section taken on line B-B in FIG. 2A.
Figure 3:
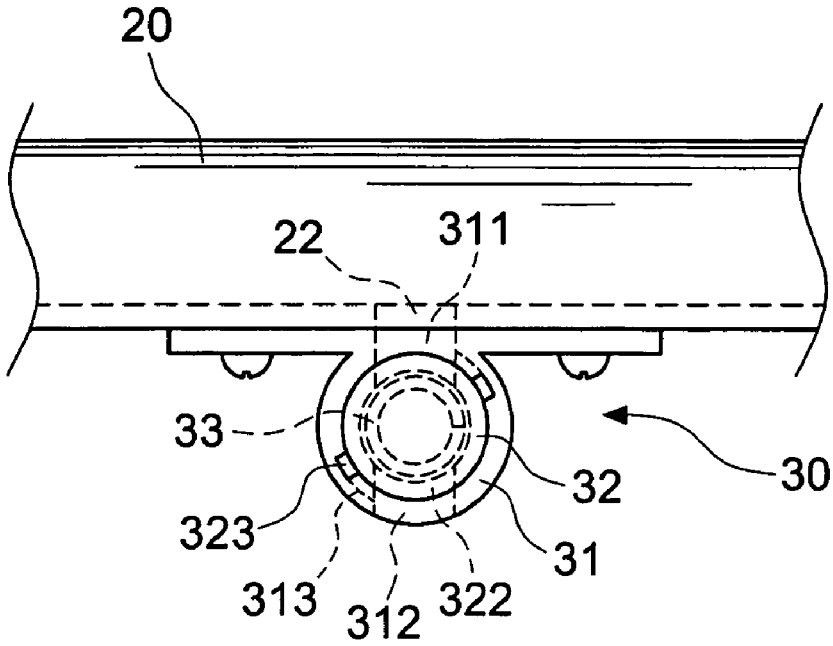
FIG. 3 is a front view of the present invention.

The control switch 30 is fastened to the bottom side of the seat 20 corresponding to the aperture 22. It mainly includes an anchor member 31 and a depressing member 32 that are movably coupled together without separating, and an elastic element 33 located between the anchor member 31 and the depressing member 32. The elastic element 33 is resilient such as a spring to allow the depressing member 32 to be depressed and extended in the anchor member 31. Referring to FIG. 3, the anchor member 31 has two through holes 311 and 312 on an upper side and a lower side opposing each other and corresponding to the aperture 22. The depressing member 32 also has two openings 321 and 322 on an upper side and a lower side opposing each other and corresponding to the through holes 311 and 312. The lift cord assembly 40 has cords 41 mating the number of the axles 23. As shown in FIG. 2B, each of the cords 41 threads through the slot 21 into the seat 20, winding around the axle 23 and passing through the aperture 22. The cord 41 has a lower end passing through the two through holes 311 and 312 of the anchor member 31 and two openings 321 and 322 of the depressing member 32 to couple with a pendent article 42 to facilitate user's pulling of the cord 41.

Figure 4:
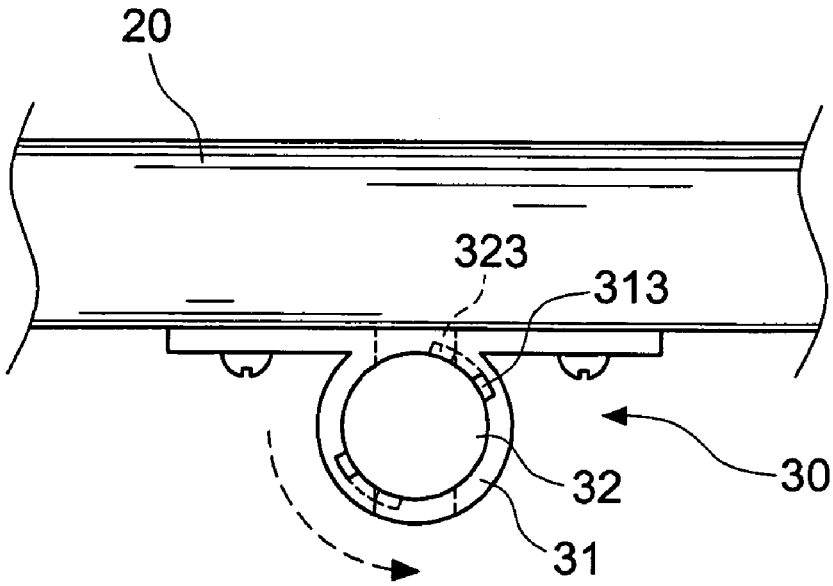
FIG. 4 is a schematic view of the present invention for installing the depressing member.

Referring to FIG. 2A, the anchor member 31 and the depressing member 32 are hollow round barrels with one end formed an opening. The anchor member 31 has two opposing grooves 313 formed on the inner periphery extending from the opening to the edge of the through holes 311 and 312. The depressing member 32 has two opposing lugs 323 on outer periphery around the openings 321 and 322. For holding the elastic element 33 in the depressing member 32 and anchor member 31, referring to FIG. 3, align the lugs 323 with the grooves 313, insert the depressing member 32 into the anchor member 31 to compress the elastic element 33. As shown in FIG. 4, turn the depressing member 32 until the lugs 323 entering the inner edge of the two through holes 311 and 312. Thus when the depressing member 32 is pushed by the elastic element 33, the two lugs 323 are retained by the inner edge of the through holes 311 and 312 without escaping so that the depressing member 32 may be engaged with the anchor member 31 without separating. When the depressing member 32 is depressed and released, it may be retracted and extended in the anchor member 31 due to the elastic element 33.

Referring to FIG. 2A, the seat 20 has screw holes 24 on the bottom at two sides of the aperture 22. The anchor member 31 has an fastening plate 314 on one side facing the seat 20 with holes 315 corresponding to the screw holes 24 to receive fastening elements such as screws to fasten the anchor member 31 to the bottom side of the seat 20.

Figure 5:
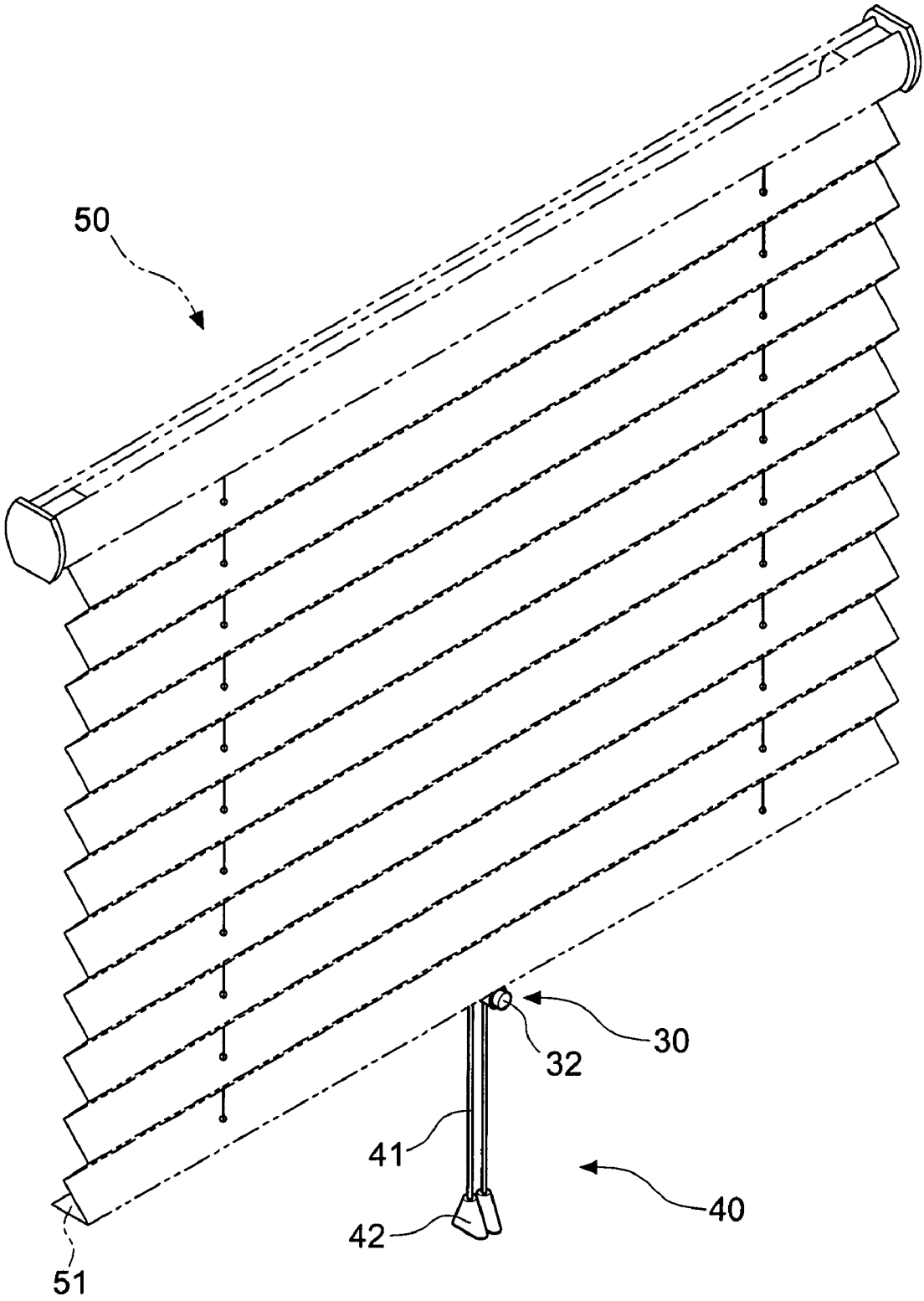
FIG. 5 is a perspective view of the present invention installed on a window shade.
Figure 9:
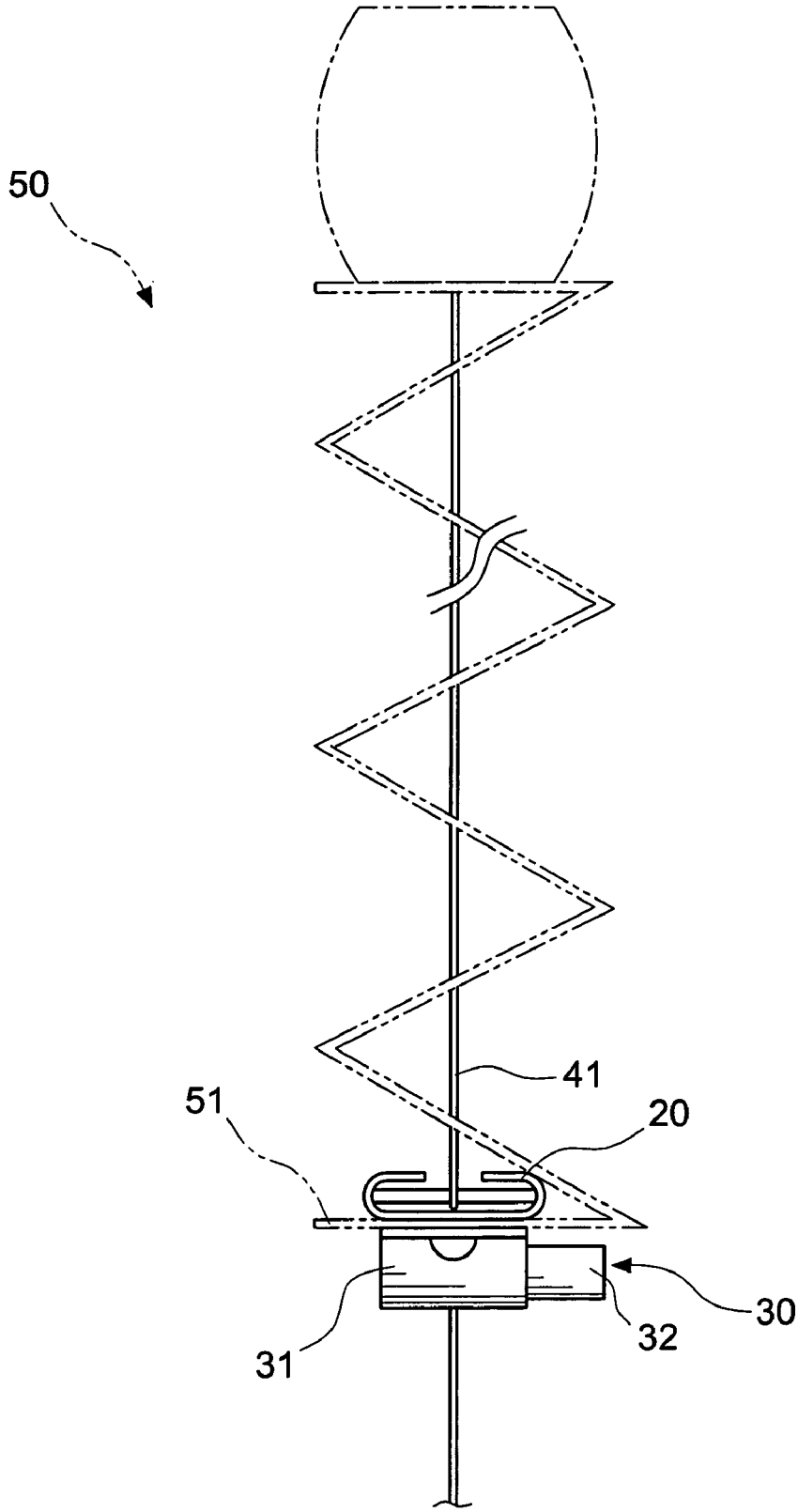
FIG. 9 is a schematic side view of the present invention installed on a window shade.

The window shade lift cord apparatus of the invention can be used on pleated window shades, blinds and the like to provide retracting and extending function. Refer to FIGS. 5 and 9 for the invention adopted for use on a window shade 50. The seat 20 is directly fastened to an inner side of a lowest slat 51 of the window shade 50. The cord 41 threads each slat 51 and runs through the lowest slat 51. The control switch 30 is located beneath the lowest slat 51 and fastened to the seat 20. The depressing member 32 of the control switch 30 faces the front direction of the window shade 50. The window shade 50 can be installed in a window or door along with other necessary accessories to block light or serve ornamental purpose.

Figure 6:
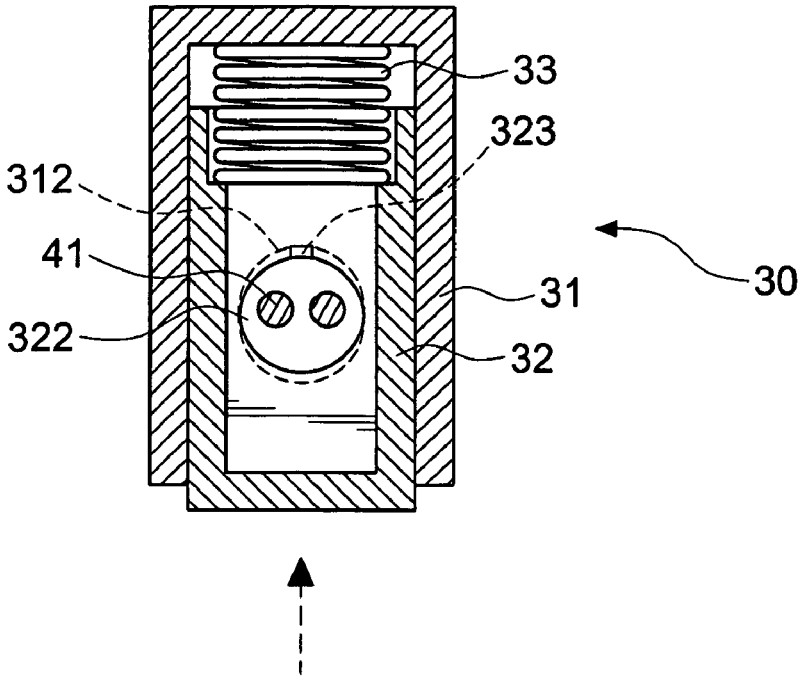
FIG. 6 is a schematic view of the present invention showing the control switch in a depressing condition.
Figure 7:
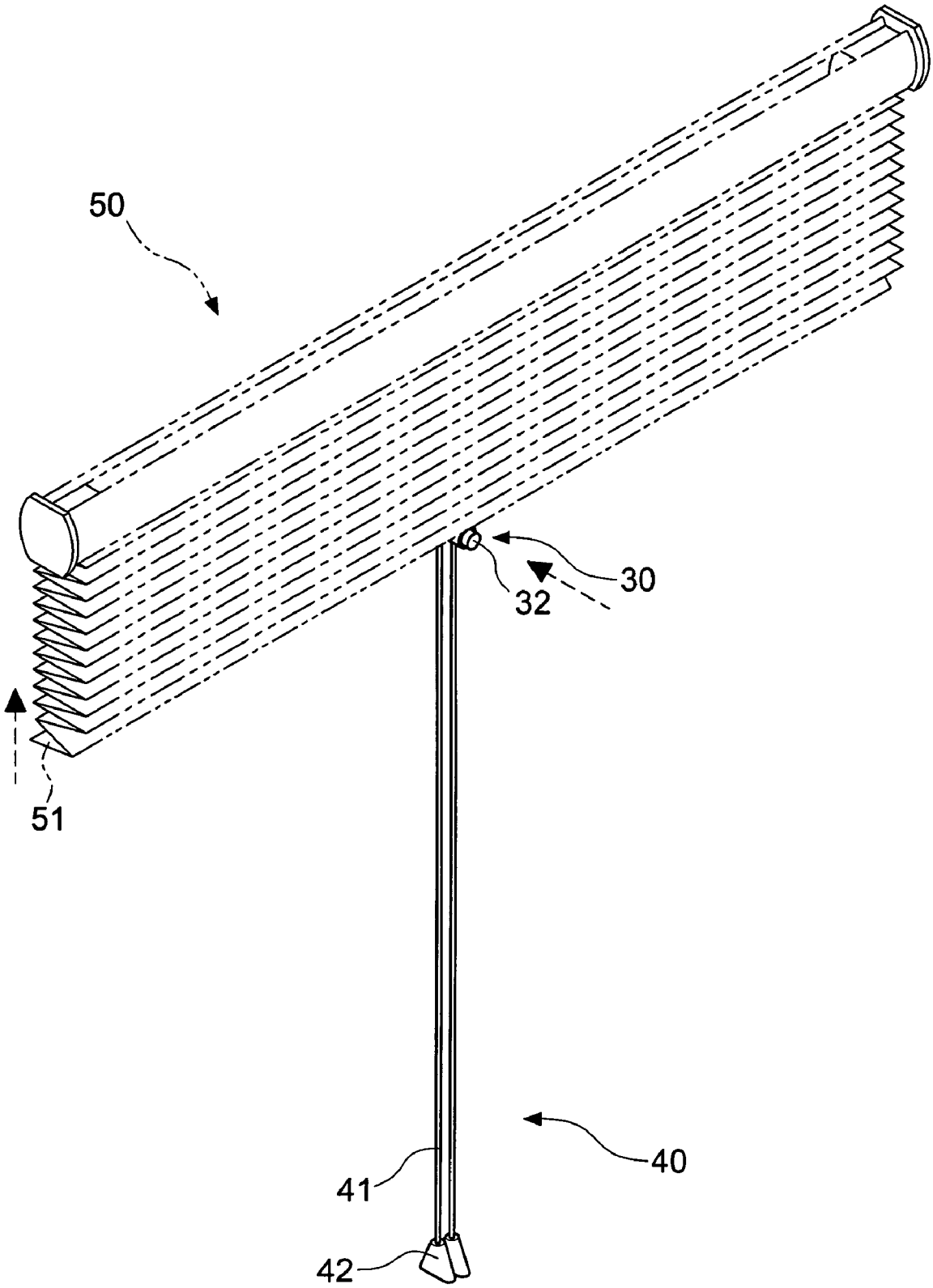
FIG. 7 is a perspective view of the present invention with the window shade in a retracting condition.

Referring to FIGS. 2B and 6, when to retract the slat 51 of the window shade 50, depress the depressing member 32 into the anchor member 31 and compress the elastic element 33. The two through holes 311 and 312 are aligned with the two openings 321 and 322. The cord 41 is in a movable condition. Hence as shown in FIG. 7, a user can depress the depressing member 32 with one hand, and pull the cord 41 with another hand. The cord 41 that threads through the slat 51 can retract the slat 51 upwards.

Figure 8:
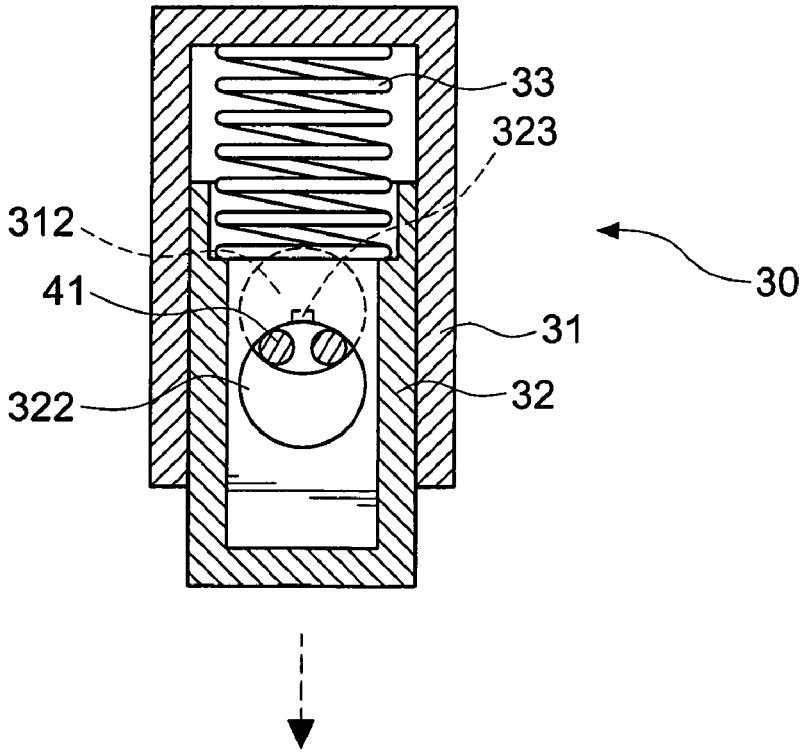
FIG. 8 is a schematic view of the present invention showing the control switch in a release condition.

Referring to FIGS. 2B and 8, when the slat 51 reaches a desired elevation, the user can release the depressing member 32. The elastic element 33 pushes the depressing member 32 to its original position. The edges of the two through holes 311 and 312 and the openings 321 and 322 are offset and clamp the cord 41 to prevent the cord 41 from moving. Thus the window shade 50 is retracted and anchored at the desired elevation.

By means of the construction set forth above, the window shade lift cord apparatus of the invention provides the following features: each cord 41 of the lift cord assembly 40 threads through the slot 21 of the seat 20, winding around the axle 23 and passing through the aperture 22 of the seat 20 and running through the anchor member 31 and depressing member 32 of the control switch 30. The lower end of each cord 41 is gathered beneath the seat 20. Hence one single control switch 30 can control the movement of each cord 41. To retract the window shade 50, the user depresses the depressing member 32 with one hand and pulls the lower portion of each cord 41 with another hand. Thus retracting of the window shade 50 can be accomplished simply and easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A window shade lift cord apparatus, comprising:

a seat being an elongate and hollow member and having a slot on the top, an aperture on the bottom and two axles located on two sides of the aperture vertical to the axis direction of a long side of the seat;

a control switch located on a bottom side of the seat corresponding to the aperture including an anchor member and a depressing member movably coupled together and an elastic element located between the anchor member and the depressing member, the anchor member having two opposing through holes corresponding to the aperture, the depressing member having two opposing openings corresponding to the two through holes; and a lift cord assembly including a plurality of cords threading through the interior of the seat and the aperture, each of the cords having a lower end passing through the through holes of the anchor member and the openings of the depressing member, and wherein the seat has screw holes on two sides of the bottom side, the anchor member having a fastening plate on one side facing the seat, the fastening plate having holes corresponding to the screw holes to receive fastening elements.

2. The window shade lift cord apparatus of claim 1, wherein the anchor member and the depressing member are respectively a hollow round barrel having an opening on one end, the anchor member having two opposing grooves formed on the inner periphery and extended from the opening to the edge of the through holes, the depressing member having two opposing lugs formed on the outer periphery to be wedged in the grooves.

3. The window shade lift cord apparatus of claim 1, wherein the elastic element is a spring.

4. The window shade lift cord apparatus of claim 3, wherein each of the cords has a bottom end coupled with a pendent article.

* * * * *